United States Patent [19]

Erasov

[11] Patent Number: 4,484,870

[45] Date of Patent: Nov. 27, 1984

[54] PLANETARY HYDRAULIC MOTOR WITH IRREGULARLY ARRANGED VALVING PARTS

[75] Inventor: Fedor N. Erasov, Odessa, U.S.S.R.

[73] Assignee: Zaporozhsky Konstruktorskotekhnologichesky Institut Selskokhozyaistvennoco Mashinostroenia, U.S.S.R.

[21] Appl. No.: 336,373

[22] PCT Filed: Mar. 2, 1981

[86] PCT No.: PCT/SU81/00024

§ 371 Date: Jan. 4, 1982

§ 102(e) Date: Jan. 4, 1982

[51] Int. Cl.[3] ..... F03C 2/00

[52] U.S. Cl. ..... 418/61 B

[58] Field of Search ..... 418/61 B

[56] References Cited

U.S. PATENT DOCUMENTS

| | | | |
|---|---|---|---|
| 3,841,800 | 10/1974 | Ohrberg et al. | 418/61 B |
| 3,910,733 | 10/1975 | Grove | 418/61 B |
| 4,106,883 | 8/1978 | Hansen et al. | 418/61 B |
| 4,380,420 | 4/1983 | Wusthof et al. | 418/61 B |

*Primary Examiner*—John J. Vrablik

*Attorney, Agent, or Firm*—Steinberg & Raskin

[57] ABSTRACT

A planetary hydraulic motor comprising a housing 1 having a stator gear 2, a housing 1 accommodating a shaft 5 having a gear 6 fixed thereon, a ring member 7 arranged eccentrically relative to the shaft 5, a cover plate 3 for mounting the rotary hydraulic motor and a cover plate 4 for feeding a working fluid, the two cover plates 3 and 4 being positioned on the both sides of the stator gear 2, and a valving mechanism. The valving mechanism includes a distributor 11 arranged in the cover plate 4 and a control valve 12, the distributor 11 and the control valve 12 being adapted to cooperate by their working surfaces 13, the latter being provided with valving ports 14, 17 an 17'. The valving ports 14 of the distributor 11 are arranged radially non-equidistantly, whereas the control valve 12 is arranged in the cover plate 4 so as to define an annular chamber 21. The housing 1 with its stator gear 2 is adapted to be displaced angularly relative to the cover plates 3 and 4. The diameter of the mounting surfaces of the housing 1 and the cover plates 3 and 4 is determined from $$Dpf\pi(D^2 - d^2) \geqq \frac{M}{8\cos\alpha}, \text{ where}$$

D is the diameter of the mounting surfaces of the housing 1 and the cover plates 3 and 4;

p is the pressure of the working fluid in the inner chamber 25 of the housing 1 of the planetary hydraulic motor;

f is the sliding friction coefficient of the mounting cover plate;

d is the inner diameter of the mounting surface of the control valve 12;

M is the torque developed by the planetary hydraulic motor; and $\alpha$ is the angle of inclination of the vector of force arising from the effect of pressure of the working fluid exerted on the cover plates 3 and 4 of the planetary hydraulic motor.

14 Claims, 17 Drawing Figures

PLANETARY HYDRAULIC MOTOR WITH IRREGULARLY ARRANGED VALVING PARTS

BACKGROUND OF THE INVENTION

This invention relates to hydraulic positive displacement devices, and more specifically to planetary hydraulic motors.

There is known an internal-gear type hydraulic pump or more (U.S. Pat. No. 3,087,436; published Apr. 30, 1963, Cl. 418-61) comprising an outer stator gear and an inner star gear disposed eccentrically relative thereto, the spaces between the two gears defining volume chambers of varying volume to convert the pressure energy of the incoming fluid into mechanical energy of the rotating shaft. The volume chambers of this motor are confined at the two sides thereof by a cover plate and a wear plate attached to the housing, the latter accommodating a valving mechanism and a tooth-type coupling intended to translate the compound motion of the inner star gear into shaft rotation.

In this known device a control valve of the valving mechanism is driven by universal-joint connections of the toothed coupling, the teeth thereof being subjected to considerable loads which result in their wear and consequently in a phase displacement of the passage of the working fluid into the volume chambers entailing reduced hydromechanical efficiency of the motor. Another disadvantage is that the valving mechanism featuring the universal-joint connections tends to increase longitudinal dimensions of this hydraulic motor. Therefore, a planetary hydraulic motor of the above construction has low efficiency and reliability and requires that components thereof be manufactured to close tolerances.

Also known is a planetary hydraulic motor (cf. USSR Inventor's Certificate No. 181,977; IPC F 05 B; published in the Bulletin "Discoveries, Inventions, Industrial Designs and Trademarks", No. 10, 1966—in Russian) comprising disposed in one plane two pairs of gears—the outer working one, and the inner driving one, and two cover plates arranged at the outer stator gear with a ring rotor having inner teeth cooperating with the shaft teeth and outer teeth engaging with the teeth of the stator gear to define volume chambers.

In this planetary hydraulic motor the function of distributor is performed by the ring rotor having at the end faces thereof axial passages communicating with the spaces between the teeth. The end face of one of the cover plate contacting the ring rotor is likewise provided with axial passages, some of them being adapted to communicate with a working fluid inlet passageway, the others communicating with a working fluid outlet passageway. A disadvantage inherent in the abovedescribed planetary hydraulic motor resides in a rather low delivery rate thereof caused by the small passage area of the passages provided in the ring rotor and one of the cover plates.

There is further known a planetary hydraulic motor (cf. USSR Inventor's Certificate No. 176,186; IPC F 05 B; published in the Bulletin "Discoveries, Inventions, Industrial Designs and Trademarks" No. 21 of Oct. 26, 1965—in Russian) comprising a ring rotor positioned essentrically relative to a shaft, and an outer stator gear enclosed by two cover plates. A valving mechanism of this motor is fashioned as a stationary disk provided with a series of axial passages and a cylindrical sleeve having at the outer surface thereof helical grooves communicated by radial passages in the ring rotor with volume chambers of the ring rotor and alternately communicating with axial passages of the cover plate, the passages being arranged at 180° relative to the corresponding volume chambers.

The helical sleeve is provided with inner teeth adapted to come into meshing engagement with the teeth of the stationary shaft. The ring rotor of the hydraulic motor is subjected to axially acting forces produced by the pressure of the working fluid in the valving mechanism.

Yet another planetary hydraulic motor (cf. French Pat. No. 2,056,110; published May 14, 1971; IPC F 04 C 1/00) comprises positioned in one plane two gear sets: an inner working one and an outer driving one: two cover plates secured on the outer stator gear with an eccentrically arranged ring rotor interposed between the cover plates, the ring rotor having outer teeth mating with the teeth of the stator gear and inner teeth mating with the teeth of the shaft gear to define volume chamber.

The ring rotor of this planetary hydraulic motor functions as a distributor, an end face of this ring rotor being provided with zigzag grooves in communication with the interteeth space of the volume chambers. A disk member is secured on the shaft to adjoin the grooves, the disk having axial through passages communicated with the zigzag grooves. Arranged between the disk member and the cover plate adjacent thereto are annular passages to feed and discharge the working fluid, the annular passages being separated by an annular wall dividing the volume chambers and effecting the distribution of the working fluid into the volume chambers during the movement of the ring rotor jointly with the disk. This valving mechanism featuring the zigzag grooves on the ring rotor closed by the disk moving jointly with the ring rotor requires close manufacturing tolerances and has an excessive sealing periphery which reduces the delivery rate of the planetary hydraulic rotor. The provision of the zigzag grooves increases the overall dimensions of the motor, while the disk member is subjected to considerable forces exerted thereon by the pressure of the working fluid.

A planetary hydraulic motor which bears closest resemblance to the one to be described in the present description (cf. USSR Inventor's Certificate No. 696,179; IPC F 04 C 1/00; published in the Bulletin "Discoveries, Inventions, Industrial Designs and Trademarks" No. 41 of Nov. 5, 1979—in Russian) comprises a housing having a stator gear, the stator gear being confined on one side by a mounting cover plate and on the other side by a cover plate for feeding a working fluid, a shaft installed in the housing and having a gear secured thereon, a ring rotor arranged eccentrically relative to the shaft and adapted to cooperate with the shaft gear and with the stator gear of the housing. The stator gear and outer teeth of the ring rotor come into a meshing engagement with each other, while the shaft gear and inner teeth of the ring rotor cooperate to define volume chambers receiving an expelling the working fluid supplied by a valving mechanism. The valving mechanism includes secured on the shaft a distributor and arranged in the cover plate for feeding the working fluid a control valve, the distributor and the control valve being adapted to come into contact by their working surfaces having valving ports thereon. The volume chambers are confined on one side by a wear plate fixedly secured on the shaft and on the other side by the distributor. Part of the valving ports (every other valving port) is put in registration with an inlet passageway of the pump, while the other part is arranged in a similar manner against an outlet passageway.

In this planetary hydraulic motor the working surfaces of the distributor and control valve are not relieved of the pressure of the working fluid acting thereon from the side of a nonengageable end face of the control valve, this pressure being created by the leakage of the fluid from the volume chambers. These working surfaces are generally subjected to very high specific loads which result in a premature wear of the above described planetary hydraulic motor.

Another disadvantage of the above planetary hydraulic motor resides in that the valving ports are arranged on the surface of the distributor equidistantly or at a regular angular pitch, which fails to ensure proper timing of supplying the working fluid at the moment when the volume chamber starts to expand or contract resulting in closing the liquid in the volume chambers thereby affecting the efficiency of the planetary hydraulic motor.

This planetary hydraulic motor is not provided with means for adjusting phase displacement of the working fluid entering the volume chambers.

The above planetary hydraulic motor suffers from one more disadvantage residing in that it is not provided with means relieving the axial loads exerted by the pressure of the working fluid on the bearing of the mounting cover plate which requires the employment of an additional thrust bearing. This makes the motor structurally more complicated and adds to the overall weight thereof.

SUMMARY OF THE INVENTION

The present invention is directed towards the provision of a planetary hydraulic motor having such a valving mechanism that would enable to increase the power of the motor, increase its efficiency and service life, make the motor more economical to manufacture and reduce its overall dimensions and weight.

This is attained by that in a planetary hydraulic motor comprising a housing having a stator gear, a cover plate on one side of the housing for mounting the motor and a cover plate on the other side of the housing for feeding a working fluid, a shaft arranged in the housing and having secured thereon a gear, a ring member positioned eccentrically relative to the shaft and cooperating with the shaft gear and the stator gear of the housing, the stator gear and outer teeth of the ring member being adapted to meshingly engage therebetween, the shaft gear and inner teeth of the ring member being also adapted to cooperate to define volume chambers for the working fluid to be supplied from a valving mechanism including a distributor secured on the shaft and a control valve arranged in the cover plate for feeding the working fluid, the distributor and the control valve being adapted to come into contact by their working surfaces, the latter having pluralities of valving ports arranged thereon, the volume chambers being confined on one side by a wear plate secured on the shaft and on the other by the distributor, according to the invention, the valving ports are arranged on the working surface of the distributor of the valving mechanism radially irregularly, the angular pitch thereof being determined by $$\beta_i = \frac{2\pi\kappa_i + \alpha_i}{n_1}, \text{ where}$$

$\beta_i$ is the angle between the axis of symmetry of the zero valving port communicating with one volume chamber and the axis of symmetry of each subsequent valving port;

$\kappa_i$ is the ordinal number of each subsequent valving port;

$\alpha_i$ is the angle between the axis of symmetry of the zero valving port communicating with one volume chamber and the axis of symmetry of each of the subsequent single or coupled volume chambers;

$n_i$ is the number of cycles effected in the volume chamber for one revolution of the shaft, the value of $n_i$ being determined from $$n_1 = \frac{z_1 \cdot z_3}{z_3 + z_2 \cdot (z_4 - z_3)} + 1, \text{ where}$$

$z_1$ is the number of teeth in the shaft gear;

$z_2$ is the number of teeth in the inner toothing of the ring member;

$z_3$ is the number of teeth in the outer toothing of the ring member; and $z_4$ is the number of teeth in the stator gear;

whereas the control valve of the valving mechanism is disposed in the cover plate for feeding the working fluid in such a manner as to define between the inner surface of the cover plate and the nonengageable end face of the control valve an annular chamber to be filled with the working fluid to provide an effort for urging the control valve against the working surface of the distributor during any direction of rotation of the shaft, the housing with the stator gear being adapted to be displaced angularly relative to the cover plate for adjusting the phase displacement of the working fluid entering the volume chambers and also relative to the mounting cover plate for changing the position of an inlet passageway of the motor. Further, according to the invention, the relationship between the diameter of the mounting surfaces of the housing, the mounting cover plate and the cover plate for feeding the working fluid is determined from $$Dpf\pi\,(D^2 - d^2) \geqq \frac{M}{8\cos\alpha}, \text{ where}$$

D is the diameter of the mounting surfaces of the housing, the mounting cover plate, and the cover plate for feeding the working fluid into the motor;

p is the pressure of the working fluid in the inner chamber of the housing of the planetary hydraulic motor;

f is the sliding friction coefficient of the mounting cover plate;

d is the inner diameter of the mounting surface of the control valve;

M is the torque developed by the planetary hydraulic motor; and $\alpha$ is the inclination angle of the vector of force arising from the effect of the pressure of the working fluid acting upon the cover plates of the planetary hydraulic motor.

In order to rotate the housing relative to the cover plates, as well as to reduce the overall size and weight of the planetary hydraulic motor, it is preferable that the mounting cover plate and the cover plate for feeding the working fluid be secured to the housing by means of keys placed in annular grooves provided on the outer surface of the housing and the inner surfaces of the cover plates.

In order to enlarge the passage areas of the valving ports of the distributor and reduce the specific loads exerted on the working surfaces, it is possible that the valving ports of the distributor be arranged at the conical working surface thereof in such a manner as to enable each of the valving ports to communicate with a corresponding intertooth cavity of the volume chamber of the shaft gear; the number of the valving ports must preferably be equal to the number of orbits the ring member makes around and in meshing engagement with the stator gear for one revolution of the shaft.

In order to increase the delivery rate of the valving mechanism without increasing the size of the planetary hydraulic motor, as well as to feed the working fluid through the shaft towards the volume chambers thereof for translating rotational motion from the housing of the motor to external actuating mechanisms, it is preferable that additional ports be provided on the conical working surface of the distributor between the valving ports, the number of these ports must preferably equal the number of the valving ports; each of these additional ports communicating by way of passages of the distributor and passages of a spiral sleeve disposed inside the distributor with the valving port offset 180° therefrom.

Advisably, the additional ports are communicated with the working fluid inlet and outlet passageways provided inside the shaft.

Alternatively, the valving ports of the distributor are arranged on the end face working surface thereof.

For effecting the reversal of the planetary hydraulic motor without resorting to the use of additional reversing means it has been found expedient that the control valve be arranged in the cover plate for feeding the working fluid to be capable of angular displacement relative to the cover plate for feeding the working fluid, the angle of such displacement to be equal to $$\pm \frac{\pi}{n}, \text{ where}$$

n is the total number of the end face valving ports of the control valve.

To this end, the nonengageable end face of the control valve must be provided with a slot adapted to receive a pin secured on the cover plate for feeding the working fluid.

In order to disengage the control valve from the working surface of the distributor, it is advisable to provide passages in the cover plate for feeding the working fluid and in an outlet fitting of the control valve for these passages to communicate the annular chamber of the control valve with the outlet passageway of the motor in a nutral position of the control valve.

Conveniently, the valving ports are arranged on the distributor of the valving mechanism along one radial path.

Alternatively, the valving ports are arranged on the working surface of the distributor of the valving mechanism along two radial paths.

Advisably, the control valve of the valving mechanism is provided with an inner working fluid inlet-outlet chamber separated from the inner chamber of the housing of the planetary hydraulic motor by a wall arranged between inner surface of the control valve and outer surface thereof facing the shaft.

Having in view the foregoing, the present invention makes it possible to improve the efficiency, increase the power, service life and reliability of the planetary hydraulic motor. It also enables to reduce the manufacturing costs, the weight and dimensions thereof. A reversal of the motor has also become possible without the use of additional reversing means.

DETAILED DESCRIPTION OF PREFERRED EMBODIMENTS

Figure 1:
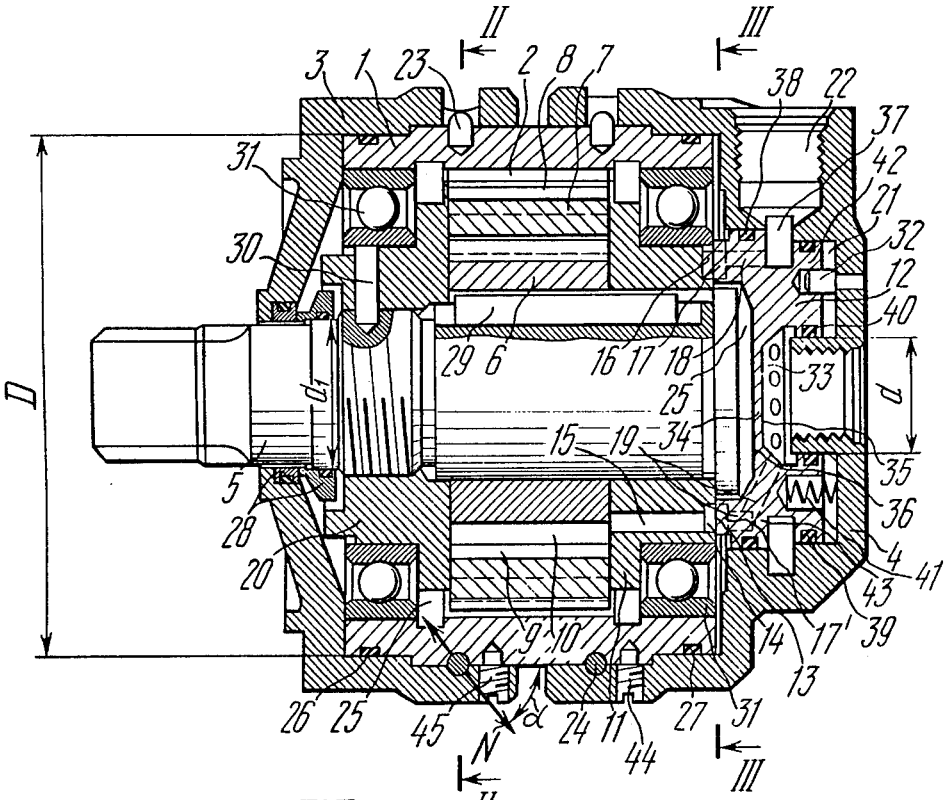
FIG. 1 is a longitudinal sectional view of a planetary hydraulic motor according to the invention.

With reference to FIG. 1, the planetary hydraulic motor comprises a housing 1 having a stator gear 2, a cover plate 3 for mounting the motor and a cover plate 4 for feeding the working fluid, the two cover plates being arranged at two opposite sides of the stator gear 2. The housing 1 receives a drive shaft 5 having arranged thereon a gear 6. The planetary hydraulic motor further comprises a ring member 7 positioned with a certain eccentricity relative to the shaft 5 and adapted to cooperate with the gears 2 and 6. The stator gear 2 and outer teeth 8 of the ring member 7 are adapted to come into a meshing engagement, while the gear 6 of the shaft 5 and inner teeth 9 of the ring member 7 define volume chambers 10 for the working fluid to be supplied thereinto and be discharged therefrom, the working fluid being supplied from a valving mechanism, the latter comprising a distributor 11 and a control valve 12 adapted to cooperate by their working surfaces 13. The working surface 13 of the distributor is provided with ports 14 which communicate with the volume chambers 10 via passages 15, and additional chambers 16 intended to ensure uniform specific loads imparted to the working surfaces 13. Ports 17 and 17' are further provided on the working surface 13 of the control valve 12, the ports being arranged in opposition to passages 18 and 19, respectively. The number of ports 17, as well as the number of ports 17', is one more than the number of ports 14.

The volume chambers 10 are confined on one side by a wear plate 20 and on the other side by the distributor 11. The wear plate 20 and distributor 11 are fixedly secured on the shaft 5, whereas the control valve 12 is disposed in the cover plate 4 to define therein an annular chamber 21 to be filled with the working fluid and provide an effort for urging the control valve 12 against the working surface 13 of the distributor 11.

The housing 1 with the stator gear 2 is adapted to be angularly displaced relative to the cover plate 4 and correspondingly relative to the control valve 12 for phase displacement of the working fluid entering the volume chambers 10, and also relative to the cover plate 3 to change the position of an inlet passageway 22 of the motor.

The relationship between diameter D of the mounting surfaces of the housing 1 and the cover plates 3 and 4 is determined by $$Dpf\pi\,(D^2 - d^2) \geqq \frac{M}{8\cos\alpha}\text{, where}$$

D=diameter of the mounting surfaces of the housing 1, the mounting cover plate 3 and the cover plate 4 for the supply of the working fluid;

p=pressure of the working fluid in the inner chamber 25 of the housing 1;

f=sliding friction coefficient of the cover plate 3;

d=inner diameter of the mounting surface of the control valve;

M=torque developed by the planetary hydraulic motor;

$\alpha$=inclination angle of the vector of force arising from the effect of the pressure of the working fluid acting upon the cover plates of the planetary hydraulic motor.

The cover plates 3 and 4 are secured to the housing 1 by means of keys 23 and 24 placed in annular grooves provided on the outer surface of the housing 1 and the inner surfaces of the plates 3 and 4. The inner chamber 25 of the housing 1 is pressure-sealed by means of seals 26, 27 and 28.

The gear 6 and the distributor 11 are splined by a pin 29 to the shaft 5 for rotation therewith. The wear plate 20 is fixed in position by a key 30. Bearings 31 are arranged between the housing 1 and the wear plate 20, as well as between the housing 1 and the distributor 11. The cover plate 4 has a pin 32 serving to limit the angular movement of the control valve 12, the latter having an inner chamber 33 separated from the inner chamber 25 of the housing 1 by a wall 34 arranged between inner surface 35 of the control valve 12 and outer surface 36 thereof facing the shaft 5.

The chamber 33 and outer inlet chamber 37 defined by the surfaces of the control valve 12 and cover plate 4 are separated from the inner chamber 25 of the housing 1 and from the annular chamber 21 by seals 38, 39 and 40. Preliminary urging of the control valve 12 against the working surface 13 of the distributor 11 is effected by means of springs 41. The seals 38 and 39 are accommodated in projections 42 and 43 of the control valve 12, the diameter of the projection 43 being in excess of the diameter of the projection 42. The cover plates 3 and 4 are fixed in position on the housing 1 by screws 44 and 45.

Figure 2:
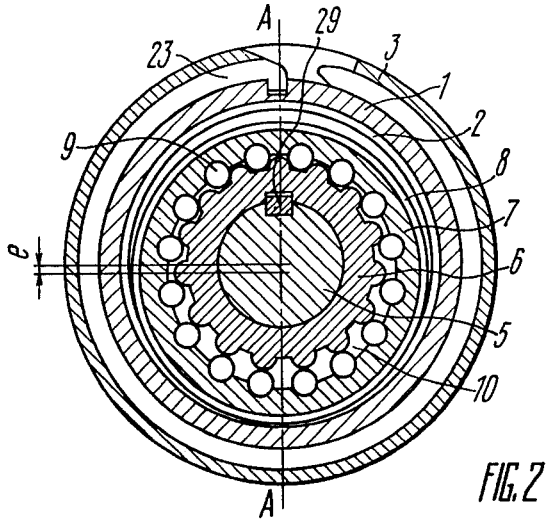
FIG. 2 shows a cross-section taken along the line II—II of FIG. 1.

Referring now to FIG. 2, there is shown a transverse section taken along the line II—II in FIG. 1. It is clear from this FIG. 2 that the ring member 7 is arranged with the eccentricity e relative to the shaft 5. It will also be seen in FIG. 3 that the valving ports 14 are arranged non-equidistantly angularly on the working surface 13 of the distributor 11.

The radial angular positioning of the valving ports 14 (FIG. 3) is determined by $$\beta_i = \frac{2\pi\kappa_i + \alpha_i}{n_1}\text{, where}$$

$\beta_i$=angle between the axis of symmetry of the zero valving port $14_o$ communicating with one volume chamber $10_o$ and the axis of symmetry of each subsequent valving port $14_i$;

$\kappa_i$=ordinal number of each subsequent valving port 14;

$\alpha_i$=angle between the axis of symmetry of the zero valving port $14_o$ communicating with one volume chamber and the axis of symmetry of each of the subsequent single or coupled chambers 10;

$n_1$=number of cycles effected in the volume chamber 10 for one revolution of the shaft 5, the value of $n_1$ being determined from $$n_1 = \frac{z_1 \cdot z_3}{z_3 + z_2(z_4 - z_3)} + 1\text{, where}$$

$z_1$ is the number of teeth in the gear 6;

$z_2$ is the number of teeth in the inner toothing 9 of the ring member 7;

$z_3$ is the number of teeth in the outer toothing 8 of the ring member 7; and $z_4$ is the number of teeth in the stator gear 2.

The ports 14 of the distributor 11 of the valving mechanism are disposed radially of one annular path.

In this modification some of the volume chambers 10 communicate in two with the corresponding valving ports 14 of the distributor 11 via passages 46 and 47.

Figure 3:
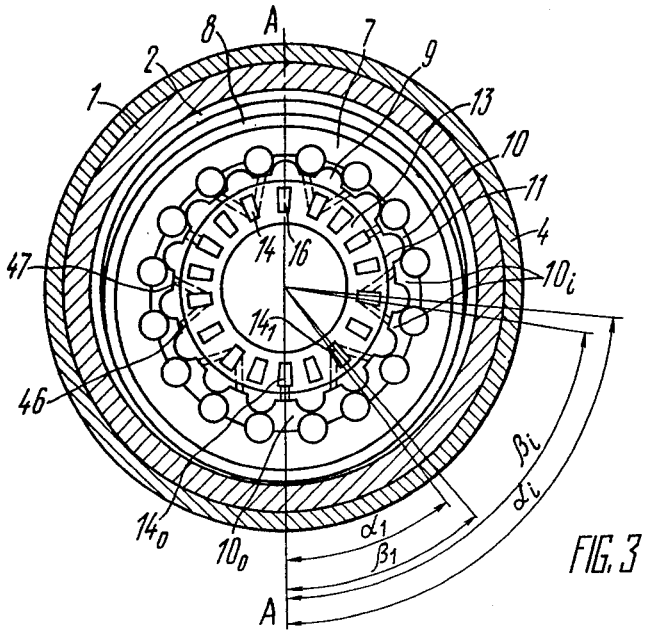
FIG. 3 shows a cross-section taken along the line III—III of FIG. 1 illustrating gear sets arranged in one plane coinciding with the plane of the working surface of a distributor of the planetary hydraulic motor according to the invention.
Figure 4:
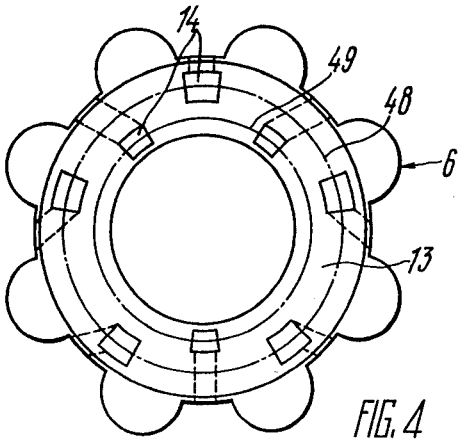
FIG. 4 illustrates a structural modification of the distributor having valving ports arranged on two annular paths.

In another preferred modification of the distributor 11 the valving ports 14 (FIG. 4) are arranged on two annular paths 48 and 49; each of the ports 14 is adapted to communicate with its corresponding volume chamber 10 (FIG. 3).

Figure 5:
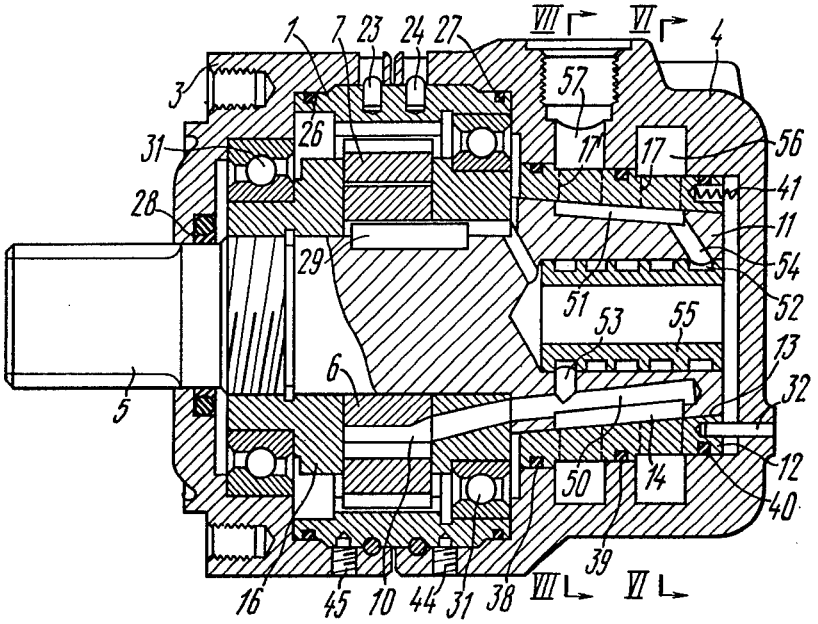
FIG. 5 shows a modification of the planetary hydraulic motor according to the invention wherein the valving ports are arranged on the conically shaped distributor with a provision for additional ports communicating with the corresponding valving ports by way of a sleeve having helical grooves thereon.

With reference to FIG. 5, the valving ports 14 of the distributor 11 are arranged on the working surface 13 fashioned, for example, as a conical surface. Each of the valving ports 14 communicates with a corresponding volume chamber 10 by way of a passage 50. The number of valving ports 14 is equal to the number of orbits made by the ring member 7 in meshing engagement with the stator gear 2 for one revolution of the shaft 5.

Additional ports 51 are provided on the working conical surface 13 of the distributor 11 between the valving ports 14, the number of these additional ports 51 being equal to the number of the ports 14, each of these ports 51 being communicated via passages 54 and 53 of the distributor 11 which are connected together via passage 52 of a spiral sleeve 55 which is disposed inside the distributor 11 with the valving port 14 offset 180° therefrom.

The working surface 13 of the control valve 12 is provided with valving ports 17 and 17' which communicate with annular chambers 56 and 57, respectively.

Figure 7:
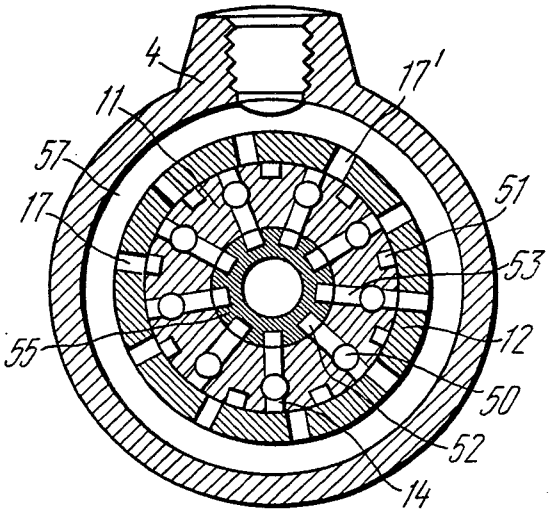
FIG. 7 is a sectional view taken along the line VII—VII of FIG. 5.
Figure 6:
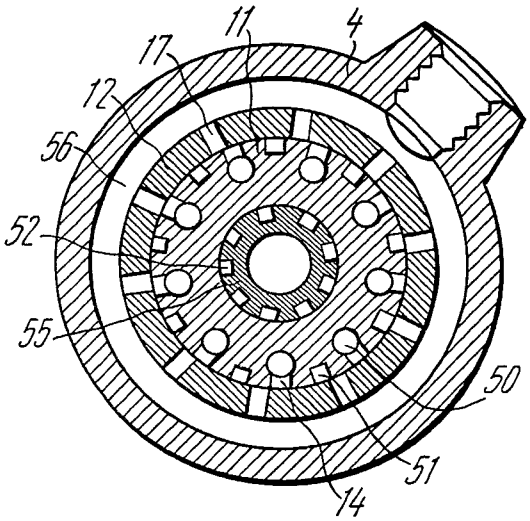
FIG. 6 is a sectional view taken along the line VI—VI of FIG. 5.

FIGS. 6 and 7 illustrate transverse sections taken along the lines VI—VI and VII—VII of FIG. 5, respectively.

The additional ports 51 communicate with fluid inlet and outlet passageways 58 and 59 (FIG. 8) provided inside the shaft 5. The passageways 58 and 59 are adapted to communicate with annular chambers 62 and 63 by means of passages 60 and 61 and ports 17 and 17' of the control valve 12.

Figure 8:
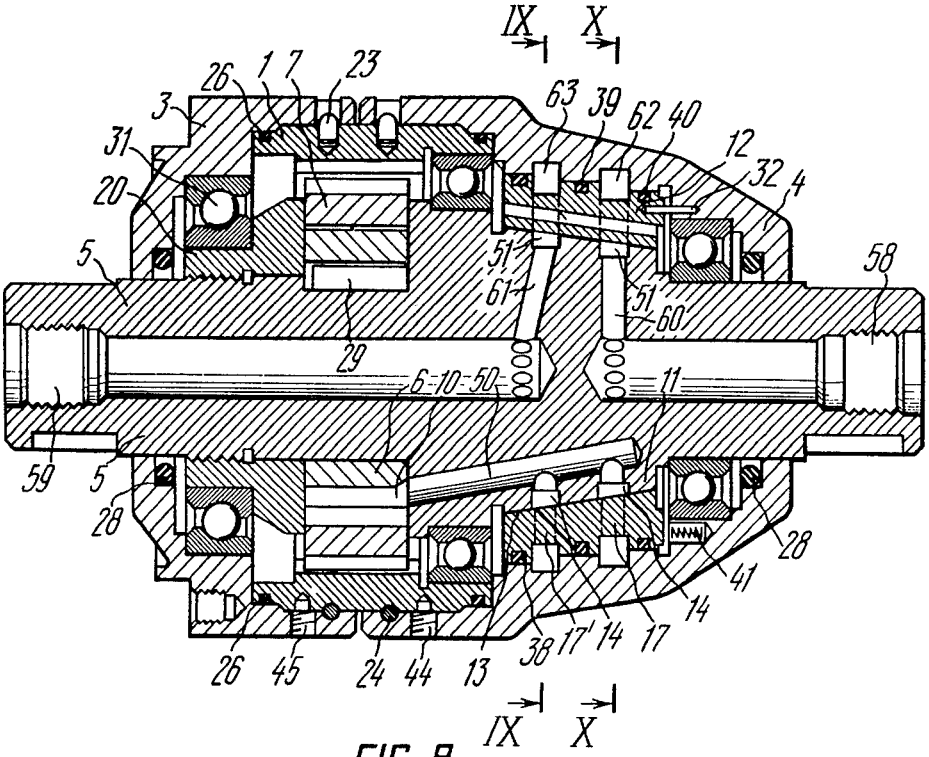
FIG. 8 illustrates a modification of the planetary hydraulic motor according to the invention with a rotating housing and the working fluid supplied through the shaft.
Figure 10:
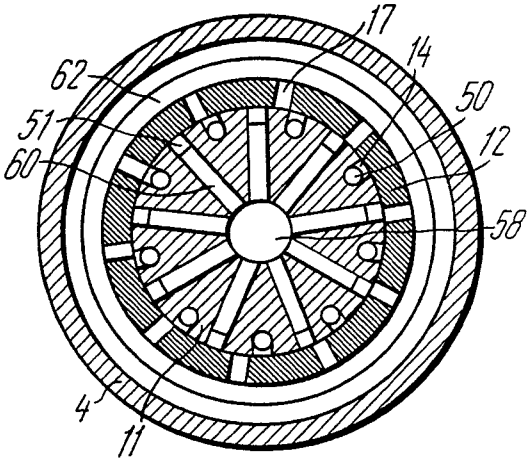
FIG. 10 is a sectional view taken along the line X—X of FIG. 8.
Figure 9:
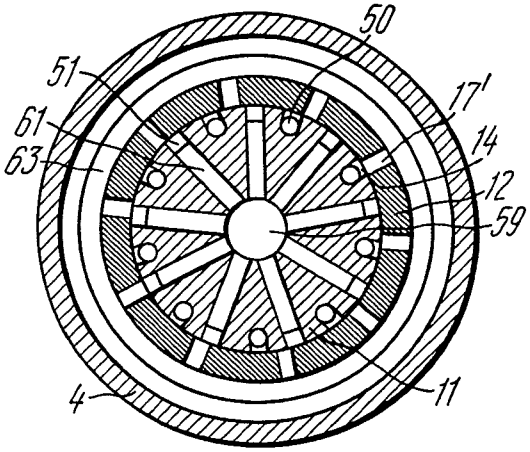
FIG. 9 is a sectional view taken along the line IX—IX of FIG. 8.

FIGS. 9 and 10 show transverse sections taken in FIG. 8.

Figure 11:
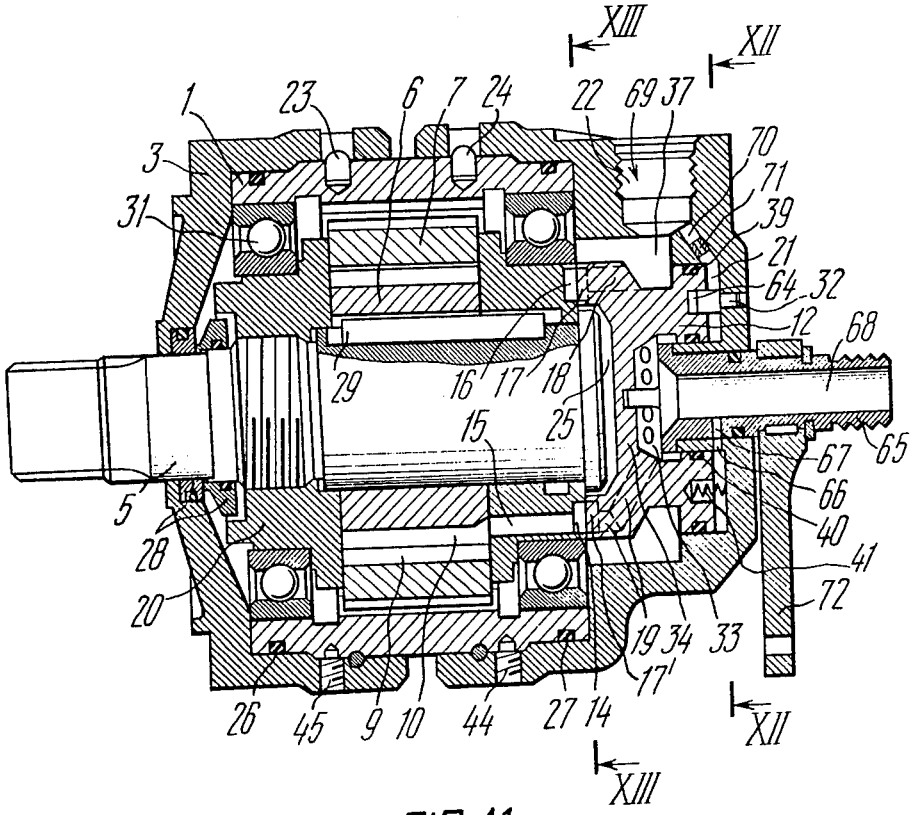
FIG. 11 shows a modification of the planetary hydraulic motor according to the invention wherein a control valve is disposed in a cover plate for feeding the working fluid to be angularly displaced relative thereto with passages providing communication between the annular chamber and an outlet passageway.

Referring now to FIG. 11, the control valve 12 is provided at the nonengageable end face thereof with a slot 64 receiving a pin 32 secured on the cover plate 4. This embodiment of the planetary hydraulic motor employs a fitting 65 as a drive for the control valve 12. Passages 66 and 67 are provided in the cover plate 4 and the fitting 65, the passages 66 and 67 being intended to communicate the annular chamber 21 of the control valve 12 with an outlet passageway 68 of the planetary hydraulic motor in a neutral position of the control valve 12. A fluid inlet passageway 69 is connected with the annular chamber 21 by way of a passage 70, the latter having a damper 71 therein. The fitting 65 is fixedly connected with the control valve 12 and a lever 72, the lever 72 being designed to impart angular movement to the control valve 12 relative to the cover plate 4.

Figure 12C:
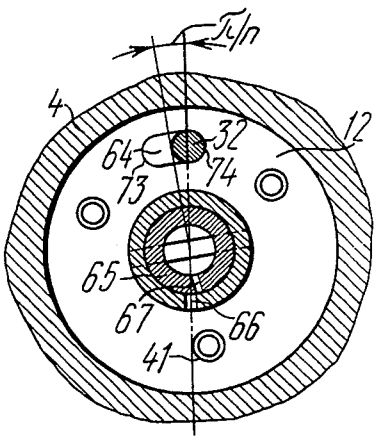
FIGS. 12 (*a, b* and *c*) illustrate a sectional view taken along the line XII—XII of FIG. 11 to represent various positions of the control valve.
Figure 12B:
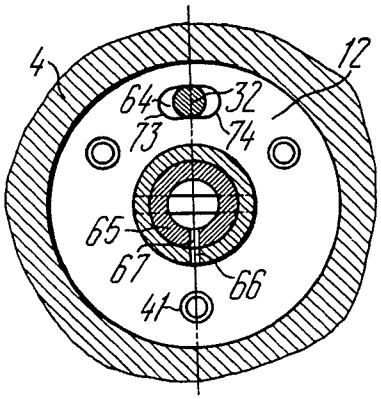
Figure 12A:
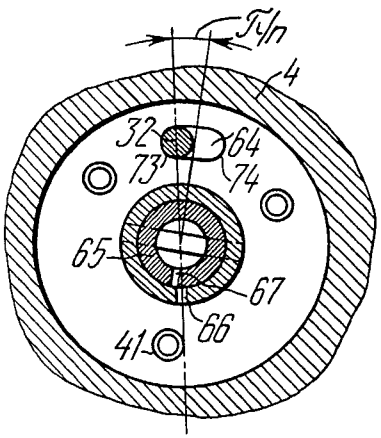

Represented in FIGS. 12*a*, 12*b* and 12*c* is a transverse section taken along the line XII—XII of FIG. 11 showing various positions of the control valve 12 relative to the pin 32 determined by the length of the slot 64.

Figure 13M:
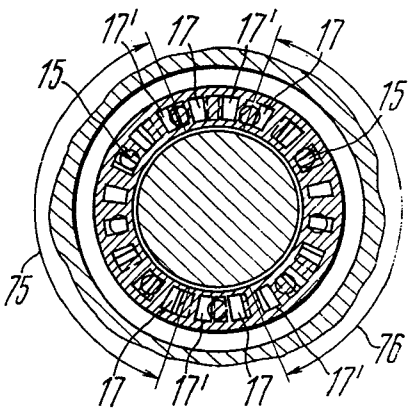
FIGS. 13 (*j, k* and *m*) show a section taken along the line XIII—XIII of FIG. 11 illustrating various positions assumed by high and low pressure zones corresponding to the positions of the control valve as seen in FIGS. 12 (*a, b* and *c*).
Figure 13K:
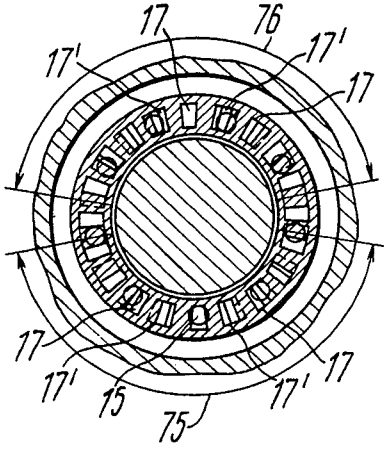
Figure 13J:
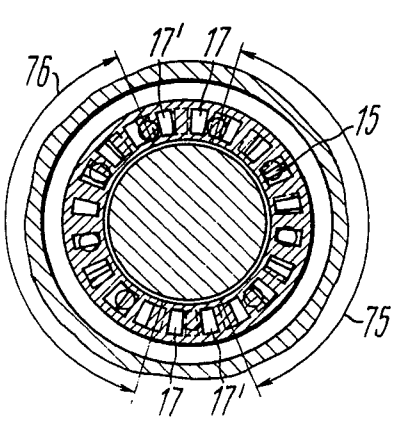

FIGS. 13*j*, 13*k* and 13*k* illustrate a transverse section taken along the line XIII—XIII of FIG. 11 showing positioning of the valving ports 17 of the control valve 12 in various positions assumed by the valve 12 and, accordingly, in various positions of a high pressure zone 75 and a low pressure zone 76.

The planetary hydraulic motor operates in the following manner.

The working fluid fed to the inlet passageway 22 (FIG. 1) via the passages 18, valving ports 17, 14 and the passages 15 is caused to enter the half of the volume chamber 10 disposed on one side of the symmetry plane AA (FIG. 2). Under the action of the pressure of the working fluid in these volume chambers the ring member 7 (FIG. 1) is caused to orbit around the stator gear 2 of the housing 1 and around the outer teeth 9 of the gear 6 thereby translating rotation to the output shaft 5. The working fluid is then discharged from the other half of the volume chambers 10 at the other side of the symmetry plane AA (FIG. 2) through the valving ports 14 and 17' and the passages 19 into the fluid outlet chamber 33 to escape from the motor.

Reversal of rotation can be effected by changing the direction of feed of the working fluid.

In the course of the travel of the working fluid through the passages of the hydraulic motor, a certain amount of pressure is created in the inner chambers 25 by virtue of the leakage of the working fluid through the gaps from the volume chambers 10 and from the valving ports 14 and 17, the resulting pressure in the chambers 25 tending to create a force acting in a direction which is opposite to the direction of force acting upon the control valve 12, or more particularly upon the nonengageable end face thereof, this latter force being produced by the pressure of the working fluid which enters the annular chamber 21 from chambers 25 through passages in the control valve 12 not illustrated in FIG. 1. The provision of the wall 34 and the annular projection 43 enables to reduce specific loads exerted on the working surfaces 13 of the distributor 11 and the control valve 12, as well as to reduce the axial load exerted on the bearing 31 of the cover plate 3. This axial load F is determined by $$F = p\frac{\pi}{4}(d_1^2 - d^2), \text{ where}$$

p is the pressure of the working fluid in the inner chamber 25 of the planetary hydraulic motor;

$d_1$ is the diameter the output shaft neck mating with a shaft seal;

d is the inner diameter of the mounting surface of the control valve 12.

After the planetary hydraulic motor has been assembled, the phase displacement of the incoming working fluid entering the volume chambers 10 is adjusted by turning the control valve 12 together with the cover plate 4 relative to the stator gear 2 and the key 24 followed by fixing the selected position by the screw 44.

The hydraulic motor is attached to an actuator by the cover plate 3. The housing 1 of the motor can be turned together with the cover plate 4 relative to the cover plate 3 for the inlet passageway 22 to assume a required position, this position being retained by the screw 45. The key 23 (FIG. 2) enables to turn the housing 1 relative to the cover plate 3 for the passageway 22 to assume any suitable for connecting a pipeline position.

As a result of hydrostatic pressure forces produced by the working fluid in the inner chamber 25 (FIG. 1) and acting upon the cover plates 3 and 4, loads N are developed in the keyed joints acting thereon at an angle $\alpha$. The housing 1 and the stator gear 2 are prevented from rotation relative to the cover plate 3 by virtue of friction forces. In order to assure that these forces are effective, the diameter D of the mounting surfaces of the cover plate 3 and the housing 1 is chosen such that the torque M developed by the planetary hydraulic motor would be less than the frictional torque enabling the housing 1 to turn relative to the cover plate 3.

With the number of valving ports 14 equal to the number of orbits made by the ring member 7 around the stator gear 2, the working fluid is forced from the volume chambers 10 connected in pairs by the passages 46 and 47 (FIG. 3) through the corresponding valving port 14.

The positioning of the valving ports 14 at the working surface 13 of the distributor 11 at an irregular angular pitch provides for the starting moment of their opening and closing at a point when the coupled and single volume chambers 10 attain their smallest and largest volumes; this prevents locking of the working fluid in the volume chambers 10 when the fluid is being expelled therefrom, which in turn adds to the efficiency of the planetary hydraulic motor.

When the working fluid is fed separately into each of the volume chambers 10, that is in case the gear 6 features small number of teeth, the valving ports 14 (FIG. 4) are preferably disposed at the working surface of the distributor angularly on the two annular paths or tracks 48 and 49 (FIG. 4) at irregular angular intervals; therewith the number of the valving ports 14 must be equal to the number of teeth of the shaft gear 6.

Feeding the working fluid into each of the volume chamber 10 separately affords to provide a maximum allowable irregularity of the torque M at a small number of teeth in the gear 6.

In the planetary hydraulic motor illustrated in FIG. 5 the working fluid is conveyed to the volume chambers 10 from the annular chambers 56 via the valving ports 17 of the control valve 12. A portion of the working fluid is conveyed through the ports 14 of the distributor 11, communicated with the ports 17 of the control valve 12, into the passage 50, and thence to the volume chambers 10. Another portion of the working fluid is passed via the valving ports 17 communicated with the additional ports 51 (FIG. 6) and via the passages 54 (FIG. 5) and passages 52 of the spiral sleeve 55 to enter the passages 53 of the distributor 11 communicated with the passages 50 and thence into the volume chambers 10. This manner of conveying the working fluid to the volume chambers 10 makes it possible to increase twofold the capacity of the valving mechanism without increasing the overall dimensions of the motor thanks to the provision of the spiral sleeve 55. This further affords to reduce the amount of hydraulic losses and in turn to increase the efficiency of the planetary hydraulic motor, as well as to unload the working surfaces 13 of the distributor 11 and the control valve 12 from the forces acting radially thereon.

The arrangement of the valving ports 14, additional ports 51 and valving ports 17 and 17' of the control valve 12 on the conical working surfaces permits to make the manufacture of the valving mechanism less labour consuming. The conical configuration of the working surfaces 13 provides for taking up the clearance between the working surfaces 13 in the course of their wear resulting in an increased durability of the planetary hydraulic motor.

The valving mechanism having the additional ports 51 (FIG. 8) arranged on the conical working surface 13 of the distributor 11 makes it possible to deliver the working fluid to the volume chambers 10 via the passageways 58 and 59 provided inside the shaft 5. For example, the working fluid may pass from the passageway 58 along the passages 60 toward the additional ports 51 of the distributor 11 and thence through one half of the ports 17 (FIG. 10) of the control valve 12 to the annular chamber 62. From the chamber 62 the working liquid is conveyed via the second half of the valving ports 17 toward the valving ports 14 of the distributor 11 and further along the passages 50 into one half of the volume chambers 10. The low pressure liquid is conveyed from the other half of the volume chambers 10 along the passages 50 toward the valving ports 14 (FIG. 8) and then through one half of the ports 17' (FIG. 9) enters the annular chamber 63. From the chamber 63 the working fluid is passed through the second half of the valving ports 17' into the additional ports 51 to travel further along the passages 61 (FIG.8) into the passageway 59 wherefrom it escapes the motor. This allows to provide a planetary hydraulic motor with externally rotating housing for translating the rotational movement therefrom to actuating mechanisms.

FIG. 11 shows a modification of the rotary hydraulic pump wherein the control valve 12 is arranged in the cover plate 4 for angular displacement relative thereto at an angle equal to $$\pm \frac{\pi}{n}, \text{ where}$$

n is the total number of the end face ports 17 of the control valve 12.

The control valve can be displaced by means of the lever 72 and the fitting 65. Three positions assumed by the control valve 12 are represented by FIGS. 12*a*, 12*b* and 12*c*.

FIG. 12*a* shows a position of the control valve 12 turned clockwise until the wall 73 belonging to the slot 64 comes into contact with the pin 32. In this position the passages 66 and 67 do not communicate, while the control valve 12 (FIG. 11) is urged against the distributor 11 by virtue of the pressure of the working fluid in the annular chamber 21. The incoming working fluid is conveyed through the inlet passageway 69 toward the valving ports 17 of the control valve 12 and one half of the ports 14 of the distributor 11 (FIG. 13*j*) and further along the passage 50 (FIG. 11) into one half of the volume chambers 10. Therewith, the high pressure zone 75 (FIG. 13) of the working fluid is created on the one side of the distributor 11, the other side thereof being the low pressure zone 76. The low pressure fluid is discharged from the volume chambers 10 (FIG. 11) via the valving ports 14 and 17' into the outlet passageway 68.

When the control valve 12 (FIG. 12*b*) is positioned to assume a neutral position, the passages 66 and 67 communicate with each other and the annular chamber 21 (FIG. 11) is not under pressure produced by the working fluid, because in this case the working fluid enters the annular chamber 21 via the damper 71; this results in that the pressure of the working fluid in the annular chamber 21 amounts to essentially less than the pressure of the working fluid supplied to the passageway 69 or in the valving ports 17, whereby the control valve tends to depart from the working surface 13 of the distributor 11 and the working fluid is caused to flow at a low pressure from the passageway 69 to the passageway 68.

During the neutral position of the control valve 12 the low pressure zone 76 and the high pressure zone 75 will assume positions best seen in FIG. 13*k*.

FIG. 12*c* illustrates a position of the control valve 12 turned counterclockwise until the pin 32 comes into contact with the wall 74. In this case the passages 66 and 67 do not communicate, while the working fluid pressure in the chamber 21 (FIG. 11) equals the pressure produced by the working fluid in the passageway 69. The control valve 12 is caused to be urged against the working surface 13 of the distributor 11. The zones of high and low pressure 75 and 76 (FIG. 13*m*), respectively, reverse their position by 180° relative to their position shown in FIG. 13*j*; thereby reversal of rotation of the shaft 5 is effected. The valving mechanism providing for such a reversal enables expansion of the range of application of the planetary hydraulic motor.

The planetary hydraulic motor is particularly applicable for use in the aviation industry, heavy machine building, shipbuilding and argicultural machinery building as a gearless drive of actuating mechanisms. The motor according to the invention can be built into drive wheels or into a winch drum.

I claim:

1. A planetary hydraulic motor, comprising
a housing,
a stator gear disposed within said housing,
a first cover plate disposed on one side of said housing,
a second cover plate disposed on another side of said housing,
a shaft disposed within said housing,
a gear secured onto said shaft,
a ring member eccentrically positioned with respect to said shaft,
an outer set of teeth disposed on said ring member and adapted to meshingly engage said stator gear,
an inner set of teeth disposed on said ring member and adapted to meshingly engage said shaft gear,
a plurality of volume chambers, each volume chamber being defined by said shaft gear and said inner set of teeth, said volume chambers adapted to receive operating fluid and to discharge the same therefrom,
a wear plate secured onto said shaft to define one side of each of said volume chambers,
means for supplying the operating fluid into said volume chambers, comprising
a distributor secured onto said shaft to define another side of each of said volume chambers,
a control valve disposed on said second cover plate, said distributor and control valve adapted to contact one another along working surfaces thereof, and
a plurality of valving ports disposed on the working surface of said distributor at an angular pitch determined by $$\beta_i = \frac{2\pi k_i + \alpha_i}{n_1}$$

in which
$\beta_i$ is an angle between an axis of symmetry of a first valving port communicating with a first volume chamber, and an axis of symmetry of any subsequent valving port,
$k_i$ is an ordinal number of the subsequent valving port,
$\alpha_i$ is an angle between the axis of symmetry of the first valving port communicating with the first volume chamber, and an axis of symmetry of any subsequent volume chamber, and
$n_1$ is a number of cycles effected in said volume chamber for one revolution of said shaft, determined by $$n_1 = \frac{z_1 \cdot z_3}{z_3 + z_2(z_4 - z_3)} + 1$$

in which
$z_1$ is a number of teeth on said shaft gear,
$z_2$ is a number of teeth on said inner set of teeth disposed on said ring member,
$z_3$ is a number of teeth on said outer set of teeth disposed on said ring member, and
$z_4$ is a number of teeth on said stator gear,
an annular chamber defined between an inner surface of said second cover plate and an end face of said control valve, said annular chamber adapted to be filled with operating fluid to provide an effort for urging said control valve against the working surfaces of said distributor during any rotation of said shaft,
an inlet passageway disposed in said first cover plate, and
an inner chamber defined within said housing, in which
said housing and stator gear are adapted to be angularly displaced with respect to said first and second cover plates, to change position of said inlet passageway and for adjusting phase displacement of the operating fluid entering said volume chambers, and
a relationship between a diameter of the mounting surfaces of said housing, first cover plate, and second cover plate, is determined by $$Dpf\pi(D^2 - d^2) \geqq \frac{M}{8\cos\alpha}$$

in which
D is a diameter of the mounting surfaces of said housing and said first and second cover plates,
p is a pressure of the operating fluid within said inner chamber of said housing,
f is a sliding friction coefficient of said first cover plate,
d is an inner diameter of the mounting surface of said control valve,
M is a torque developed by said motor, and
$\alpha$ is an angle of inclination of a vector force arising from the effect of pressure of the operating fluid acting upon said first and second cover plates.

2. The motor of claim 1, additionally comprising
annular grooves disposed on an outer surface of said housing and inner surfaces of said first and second cover plates, and
a plurality of keys adapted to secure said housing to said first and second cover plates by being disposed in said annular grooves.

3. The motor of claim 2, in which
the working surface of said distributor is conically-shaped,
said valving ports are situated on the working surface of said distributor,
each of said valving ports is adapted to communicate with a corresponding volume chamber, and
comprising a plurality of passages disposed in said distributor, each of said passages adapted to communicate a respective valving port with the corresponding volume chamber,
the number of said valving ports situated on the working surface of said distributor being equal to the number of orbits of said ring member around said stator gear in meshing engagement therewith, for one revolution of said shaft.

4. The motor of claim 3, comprising
a plurality of additional valving ports disposed on the working surface of said distributor and equal in number to the number of said first valving ports disposed thereon, and additional passageways disposed inside said distributor, said additional passageways communicating each of said first valving ports with a respective additional valving port offset 180° therefrom.

5. The motor of claim 4, comprising inlet and outlet passageways disposed inside said shaft and adapted to communicate with said additional valving ports in said distributor.

6. The motor of claim 1, in which said valving ports are disposed on the working surface of said distributor.

7. The motor of claim 6, additionally comprising valving ports disposed on the working surface of said control valve, and in which said control valve is disposed to be angularly displaceable with respect to said second cover plate, with an angle of displacement being equal to $$\pm \frac{\pi}{n}$$

wherein n is the total number of said valving ports disposed on the working surface of said control valve.

8. The motor of claim 7, additionally comprising a slot disposed on the end face of said control valve facing said second cover plate, a pin adapted to be received in said slot in said control valve to secure the same to said second cover plate, a fitting disposed in said second cover plate and fixedly connected to said control valve to constitute means for driving said control valve, an outlet passageway disposed in said fitting, and two passages, each respectively disposed in said second cover plate and in said fitting, said passages adapted to communicate with one another in a neutral position of said control valve, and thus communicate said annular chamber with said outlet passageway.

9. The motor of claim 7, in which said valving ports are disposed along a single radial path about said distributor.

10. The motor of claim 8, in which said valving ports are disposed on the working surface of said distributor along two radial paths.

11. The motor of claim 9, additionally comprising an inner chamber for the operating fluid disposed in said control valve, and a wall disposed between an inner surface of said control valve and an outer surface thereof facing said shaft, to separate said inner chamber disposed in said control valve from said inner chamber defined within said housing.

12. The motor of claim 7, additionally comprising valving ports disposed on the working surface of said control valve, and in which said control valve is disposed to be angularly displaceable with respect to said second cover plate, with an angle of displacement being equal to $$\pm \frac{\pi}{n}$$

in which n is the total number of said valving ports disposed on the working surface of said control valve.

13. The motor of claim 12, additionally comprising a slot disposed on the end face of said control valve facing said second cover plate, a pin adapted to be received in said slot in said control valve to secure the same to said second cover plate, a fitting disposed in said second cover plate and fixedly connected to said control valve to constitute means for driving said control valve, an outlet passageway disposed in said fitting, and two passages, each respectively disposed in said second cover plate and in said fitting, said passages adapted to communicate with one another in a neutral position of said control valve, and thus communicate said annular chamber with said outlet passageway.

14. The motor of claim 10, additionally comprising an inner chamber for the operating fluid disposed in said control valve, and a wall disposed between an inner surface of said control valve and an outer surface thereof facing said shaft, to separate said inner chamber disposed in said control value from said inner chamber defined within said housing.

* * * * *